United States Patent [19]

Boiten et al.

[11] 4,222,168

[45] Sep. 16, 1980

[54] SHAVING APPARATUS

[75] Inventors: Ebbe Boiten; Eduard W. Tietjens; Jochem J. de Vries; Tjamme de Vries, all of Drachten, Netherlands

[73] Assignee: U.S. Philips Corporation, New York, N.Y.

[21] Appl. No.: 966,833

[22] Filed: Dec. 6, 1978

[30] Foreign Application Priority Data

Nov. 14, 1978 [NL] Netherlands ..... 7811228

[51] Int. Cl.[2] ..... B26B 19/16

[52] U.S. Cl. ..... 30/43.6; 30/346.51

[58] Field of Search ..... 30/34.2, 43.4–43.92, 30/346.51; 76/104 R

[56] References Cited

U.S. PATENT DOCUMENTS

| | | | |
|---|---|---|---|
| 2,536,015 | 12/1950 | Konrad | 30/346.51 X |
| 3,088,205 | 5/1963 | Ellis | 30/436 X |
| 3,962,784 | 5/1976 | Tietjens | 30/346.51 X |
| 4,151,645 | 5/1979 | Tietjens | 30/346.51 X |

*Primary Examiner*—Gary L. Smith

*Attorney, Agent, or Firm*—Thomas A. Briody; William J. Streeter; Rolf E. Schneider

[57] ABSTRACT

There is provided a shaving apparatus having a shear plate formed with hair-entrance apertures and a cutting unit associated with and rotatable relative to the shear plate. The cutting unit comprises a cutting member having cutters and a hair-pulling member having lead cutters respectively associated with and movable relative to the cutters. A separate coupling piece is provided for securing the cutting member and the hair-pulling member together by passage through corresponding central openings in each such member. One or more connection tabs extend radially inwardly from the periphery of the central opening in the hair-pulling member for contact with the coupling piece.

1 Claim, 9 Drawing Figures

SHAVING APPARATUS

This invention relates to a shaving apparatus having a circular shear plate with hair entrance apertures and a cutting unit which is rotatable relative to the shear plate, which cutting unit comprises a cutting member, which is substantially constituted by a circular central body which is provided with cutters and which cutting member is equipped with lead cutters which are movable relative to the cutters, which lead cutters are secured to the central body of the cutting member by means of connecting arms.

Such a shaving apparatus is for example known from U.S. Pat. No. 3,962,784. This patent describes a cutting member having lead cutters which are fixed to the cutting member by glueing or spot-welding.

It is an object of the present invention to provide a construction which simplifies the fixation of the lead cutters to the cutting member and which is better adapted to mass production.

The construction proposed for this purpose is characterized in that the connecting arms are secured to the central body of the cutting member with the aid of a separate coupling piece.

A preferred embodiment is characterized in that the coupling piece is provided with substantially radial spokes, the end of a connecting arm of a lead cutter being clamped between the central body of the cutting member and a radial spoke.

Moreover, an embodiment as described in the preceding paragraph may be such that a radial spoke extends to near a lead cutter and constitutes a stop which limits the movement of said lead cutter.

The radial spokes may extend beyond the circumference of the cutting member. The cutting unit, comprising the cutting member, the lead cutters and the coupling piece, can then simply be held by the ends of the radial spokes during assembly or dissassembly. The radial spokes can be interconnected by an annular portion of the coupling piece.

The coupling piece may also be employed for coupling to the drive spindle, as in a construction which is characterized in that the coupling piece also has a coupling opening for the drive of the cutting unit.

A special embodiment is characterized in that the coupling piece is provided with resilient tabs with hook-shaped projections, which tabs in the assembled condition of the coupling piece and the cutting member extend through openings in the cutting member and constitute a snapped connection between the coupling piece and the cutting member.

Apart from the lead cutters other components, such as for example a separate mass-inertia body, may be secured to the cutting member with the aid of the coupling piece.

An embodiment having lead cutters which are secured to a separate central plate-shaped portion by means of connecting arms, said central plate-shaped portion having a central opening for the coupling piece, is characterized in that the circumference of the central opening of the central plate-shaped portion is provided with at least one substantially radially directed connection tab for contact with the coupling piece.

The invention is also embodied in a cutting unit or a coupling piece as used in one of the embodiments of a shaving apparatus as defined hereinbefore.

The invention will now be described in detail in connection with the accompanying drawings in which.

Figure 1:
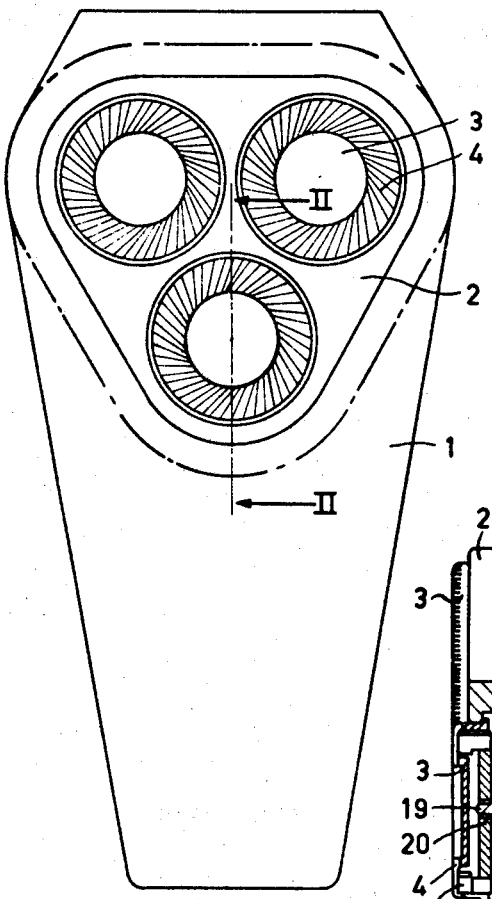
FIG. 1 shows an elevation of a shaving apparatus having three shear plates.
Figure 2:
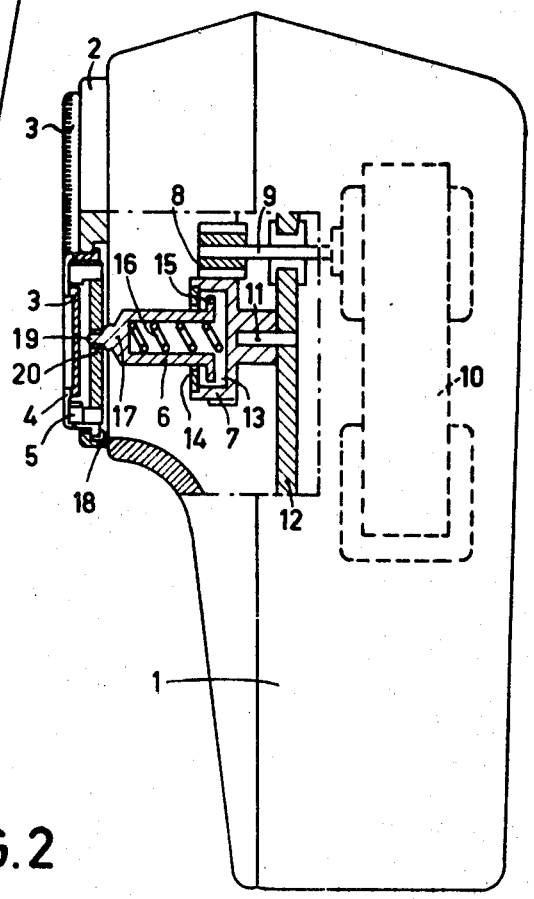
FIG. 2 shows the shaving apparatus of FIG. 1 in side view and partly in a cross-section taken on the line II—II in FIG. 1.

The shaving apparatus in accordance with FIGS. 1 and 2 comprises a housing 1, of which a part takes the form of a shear-plate holder 2 for three shear plates 3. The shear plates 3 have hair-entrance apertures 4.

Figure 3:
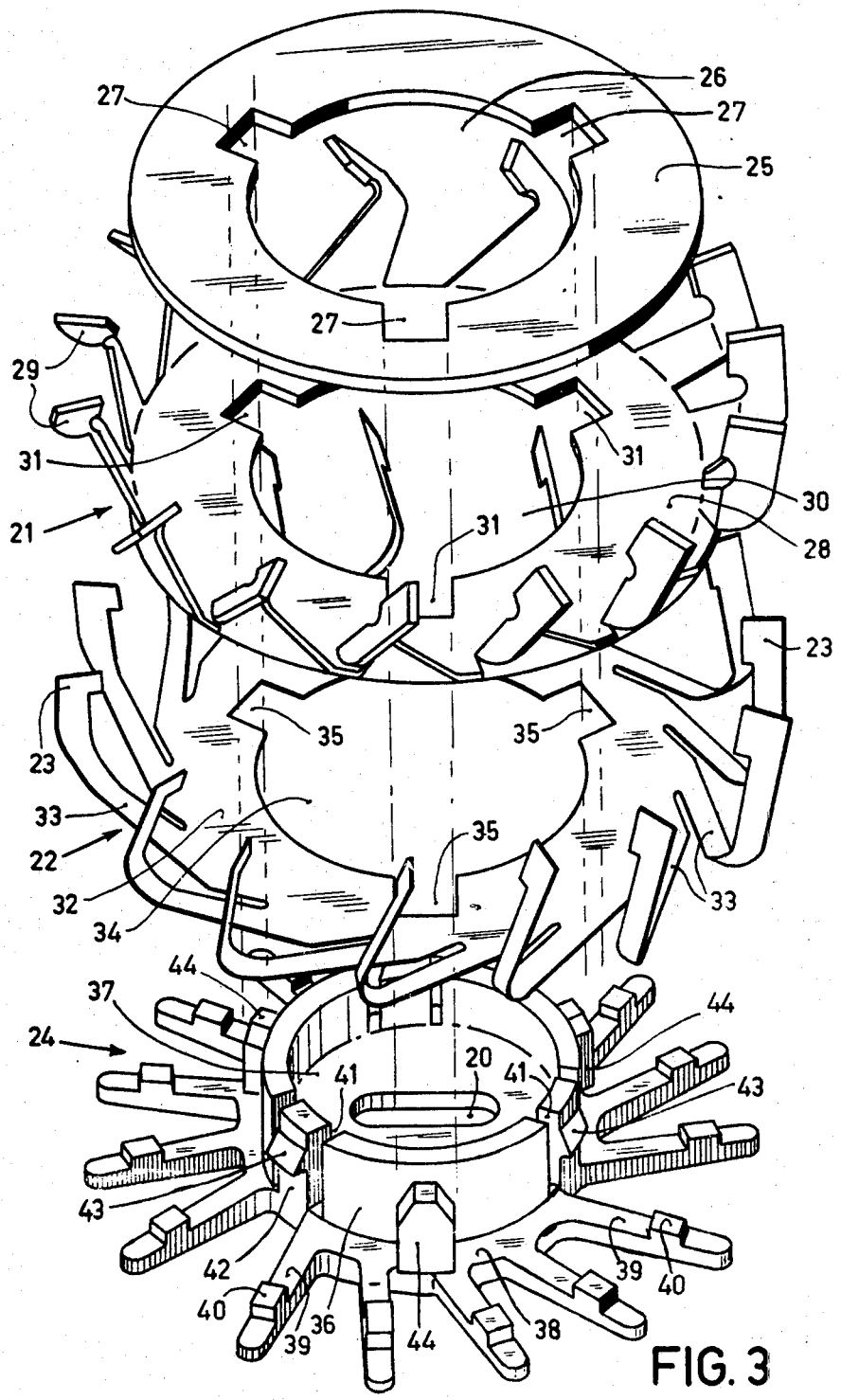
FIG. 3 shows a perspective view on an enlarged scale of the cutting member with the coupling piece, the lead cutters and the mass-intertia disc in disassembled condition.
Figure 4:
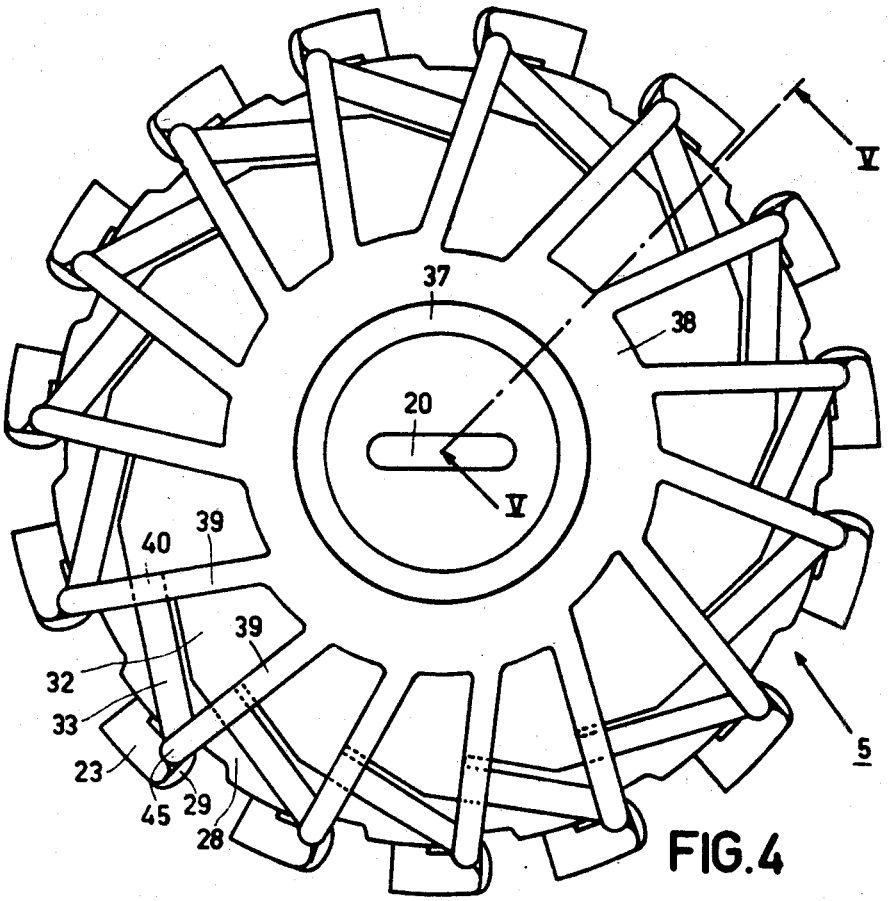
FIG. 4 shows a plan view on an enlarged scale of the parts shown in FIG. 3, which parts have been assembled into a cutting unit.
Figure 5:
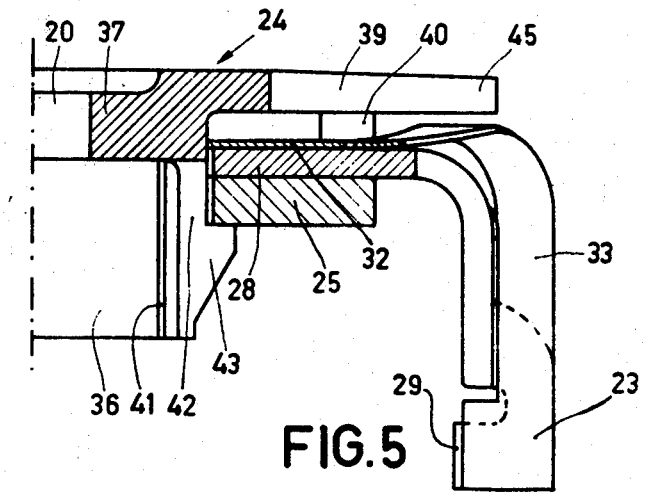
FIG. 5 is a cross-section on an enlarged scale taken on the line V—V in FIG. 4.

As shown in the partial cross-section of FIG. 2, a cutting unit 5 is situated on the inner side of a shear plate 3, which unit for the sake of clarity is shown schematically, but is shown in detail and on an enlarged scale in FIGS. 3 through 5.

The cutting unit 5 is coupled to the electric motor 10 by means of the hollow spindle 6 (FIG. 2), the gear wheels 7 and 8 and the spindle 9, so that the cutting unit is rotatable relative to the associated shear plate 3. The gear wheel 7 is rotatably journalled on a pin 11 which is fixed in a mounting plate 12. The gear wheel 7 has a recess 13, which is closed by a cover plate 14. This cavity accommodates the flange 15 at the end of the hollow spindle 6. By giving the flange 15 a non-round, for example square, shape and shaping the recess 13 accordingly, a coupling is obtained for the transmission of the rotary movement of the gear wheel 7 to the spindle 6. The spring 16, which for its greater part is situated in the hollow spindle 6 and is tensioned between the hollow spindle 6 and the gear wheel 7, exerts a force on the spindle 6 in the direction of the cutting unit 5. As the cylindrical portion 17 of the spindle 6 bears against the cutting unit 5 this force is exerted on the cutting unit and via the cutting unit on the shear plate 3, so that the shear plate is pressed against the shear plate holder 2 along the flanged edge 18. As a result of external forces, as may for example occur during use of the shaving apparatus, the shear plate 3 together with the cutting unit 5 and the spindle 6 can be pressed inwards against the action of the spring 16.

The coupling for the transmission of the rotary movement between the spindle 6 and the cutting unit 5 is obtained in that the spindle 6 has an end 19 of substantially rectangular-cross-section. This end 19 is situated in a corresponding coupling opening 20 of the cutting unit 5.

The coupling to the electric motor 10 as described in the foregoing is identical for the three cutting units of the apparatus in accordance with FIGS. 1 and 2, three gear wheels 7 being in engagement with a single centrally disposed gear wheel 8 on the motor spindle 9.

The cutting unit 5 comprises a cutting member 21, a hair-pulling member 22 with lead cutters 23, a coupling piece 24 and a mass-inertia body 25, which components are shown in perspective and in disassembled condition in FIG. 3.

The mass-inertia body, i.e. the annular disc 25, has a central opening 26 and three cut-outs 27 on the inside.

The cutting member 21 is substantially constituted by a central body 28 which is provided with cutters 29 at the circumference. In a similar way as the mass inertia body 25, the central body has a central opening 30 and three cut-outs 31.

The hair-pulling member 22 comprises a central plate-shaped portion 32 to which the lead cutters 23 are connected by means of the connecting arms 33. The central plate-shaped portion 32 also has a central opening 34 and three cut-outs 35.

The coupling piece 24 comprises a cylindrical portion 36 with a partition 37 and a flange 38. In the partition 37 the coupling opening 20 is formed for the coupling to the hollow spindle 6. From the flange 38 the spokes 39 extend in a substantially radial direction. These spokes 39 are each provided with a cam 40. Owing to the cut-outs 41 in the cylindrical portion 36 the resilient tabs 42 are formed, which at the ends are provided with hook-shaped projections 43. On the outside of the cylindrical portion 36 three ridges 44 are disposed.

The cutting member 21, the hair-pulling member 22 with the lead cutters 23, and the mass-inertia body 25 can be simply assembled into a cutting unit 5 with the aid of the coupling piece 24. For this purpose the mass-inertia body 25, the cutting member 21 and the hair-pulling member 22 are stacked onto each other in the sequence shown in FIG. 3, the central openings 26, 30 and 34 as well as the cutouts 27, 31 and 35 then being coincident. The cylindrical portion 36 of the coupling piece 24 is passed through the central openings 26, 30, and 34, the hook-shaped projections 43 moving inwards in a radial direction. The ridges 44 then engage with the cut-outs 27, 31, and 35, so that the components 21, 22, 24 and 25 cannot rotate relative to each other. The hook-shaped projections 43 snap behind the mass-inertia body 25, so that the components 21, 22, 24 and 25 are fixed to each other. The snapped connection with the aid of the hook-shaped projections 43 on the resilient tabs 42 also simplifies disassembly of the cutting unit 5.

In the assembled condition of the cutting unit 5 (FIGS. 4 and 5) the lead cutters 23 engage the cutters 29. The end of the connecting arm 33 of a lead cutter 23 which adjoins the central plate-shaped portion 32 is located between the cam 40 of a radial spoke 39 and the central body 28 of the cutting member 21. The coupling piece 24 has been dimensioned so that in the assembled condition of the cutting unit 5 the radial spokes exhibit a slight elastic flexure as a result of which such inner end of each connecting arm 33 is clamped between the cam 40 and the central body 28. As a result of the elastic properties of the non-clamped portion of the connecting arm 33, the lead cutter 23 is movable relative to the associated cutter 29.

The outer end 45 of a radial spoke 39 is disposed near a connecting arm 33 which adjoins the connecting arm which is clamped in position by the cam 40 of the same radial spoke 39. The end 45 constitutes a stop for said adjacent connecting arm and thus limits the movement of the lead cutter connected to said arm. Obviously, it is also possible to design the radial spokes in such a way that one radial spoke serves for retention and as a stop for the same connecting arm.

The elastic properties of a connecting arm 33 are inter alia dependent on the location of clamping of the end which adjoins the central plate-shaped portion 32, i.e. the location where the cam 40 engages with the connecting arm 33. The elastic properties of a connecting arm can be determined simply yet accurately by the shape and the dimensions of the coupling piece 24. The coupling piece is preferably manufactured from a plastic.

Figure 6:
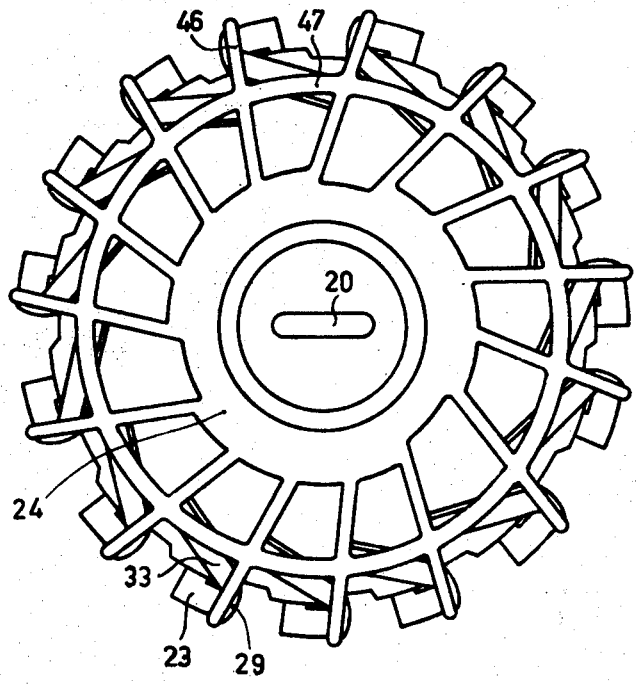
FIG. 6 is a plan view as in FIG. 4 but on a reduced scale of a different embodiment of the cutting unit.

In the embodiment of FIG. 6, which shows a plan view similar to that of FIG. 4, the radial spokes 46 extend beyond the circumference of the cutting member. During assembly or disassembly the cutting unit can then be held by the ends of the radial spokes, so that the risk of damage to the other parts is reduced. The radial spokes are interconnected by an annular member 47 so as to increase the strength and the rigidity of the coupling piece 24. The space which is left between the radial spokes, ensures that the removal of haircuttings from the vicinity of the cutting unit is impeded to the least possible extent.

Figure 7:
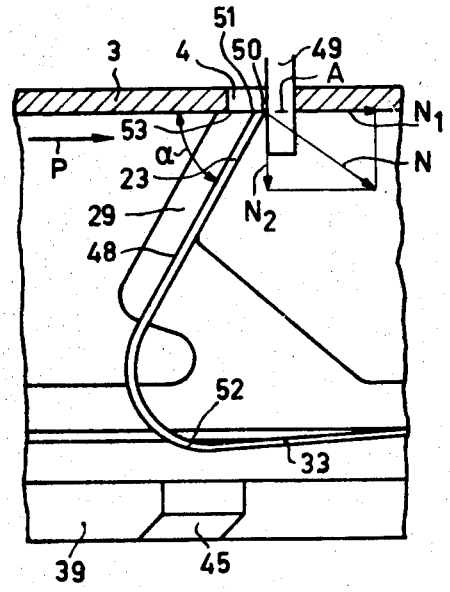
FIGS. 7 and 8 illustrate on an enlarged scale the operation of a lead cutter.
Figure 8:
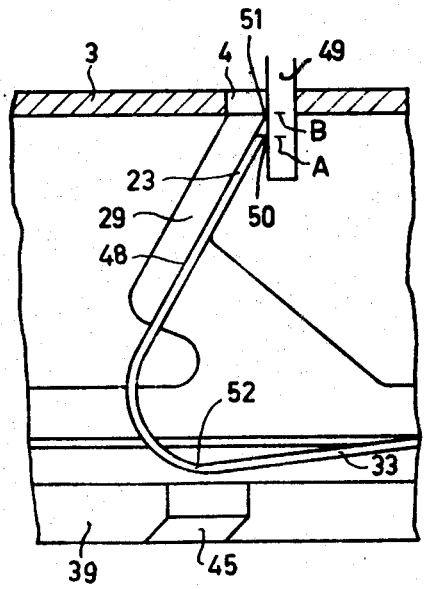

FIGS. 7 and 8 schematically show a side view of a part of the cutting unit 5 in accordance with FIGS. 3 through 5 and a part of the shear plate 3 and serve to illustrate the operation of the lead cutters.

As shown in FIGS. 7 and 8 the lead cutter 23 engages with the guide wall 48 of the cutter 29 which wall is inclined relative to the shear plate 3. When a hair 49 is caught in a hair-entrance aperture 4, said hair will soon come into contact with the sharp edge 50 of the lead cutter 23 at the location A owing to the rotary movement of the cutter 29 and the lead cutter 23. The sharp edge 50 is such that it will slightly penetrate the hair 49, without cutting off the hair. The reaction force which is exerted on the lead cutter 23 by the hair 49 may be directed oppositely to the direction of movement P. This force will be counteracted by the component $N_1$ of the normal force N which is exerted on the lead cutter 23 by the wall 48 of the cutter 29. (FIG. 7). For the sake of simplicity the slight frictional forces between the lead cutter 23 and the cutter 49 have been neglected. The component $N_2$ of the normal force N will cause the lead cutter 23 to slide along the wall 48. The angle $\alpha$ between the wall 48 and the wall 53 of cutter 29 which engages with the shear plate 3 should be smaller than 90°.

Owing to inter alia the natural elasticity of the skin the hair 49 will be moved along by the lead cutter 23 until the cutting edge 51 of the cutter 29 has reached the hair at the location B (FIG. 8). Subsequently, the hair will be cut by cooperation of the shear plate 3 and the cutter 29. Thus, a part of the hair 49 is cut off which is longer than the part which would be cut off without the lead cutter by a length equal to the distance between A and B, so that a better shaving result is obtained.

As is evident from FIG. 8 the point 52 of the connecting arm 33 has not yet reached the end 45 of the spoke 39 in this position of the lead cutter 23. However, owing to the inertial forces there is a risk that the lead cutter 23 moves further in the direction away from the shear plate 3, in which case the end 45 functions as a stop which limits the movement of the connecting arm 33 and thus of the lead cutter.

In the embodiment described in the foregoing the lead cutters 23 are parts of a hair-pulling member 23.

However, the coupling piece may also be employed for the fixation of separate lead cutters to the cutting member.

If the lead cutters constitute a part of a hair-pulling member with a central plate-shaped portion, the coupling piece may also engage with said central plate-shaped portion by clamping.

Instead of a snapped connection the coupling piece may also be fixed to the cutting member in a different manner, for example by welding, screwing or glueing.

Generally, the use of lead cutters will impose limits on the speed of rotation of the cutting unit. Since in hair-cutting the amount of kinetic energy of the cutting unit is an important factor, the operation of the apparatus may be improved in some cases by increasing its mass, for example, by means of an additional mass-inertia body 25.

However, the coupling piece can also be made so heavy that an additional mass-inertia body is not necessary.

Figure 9:
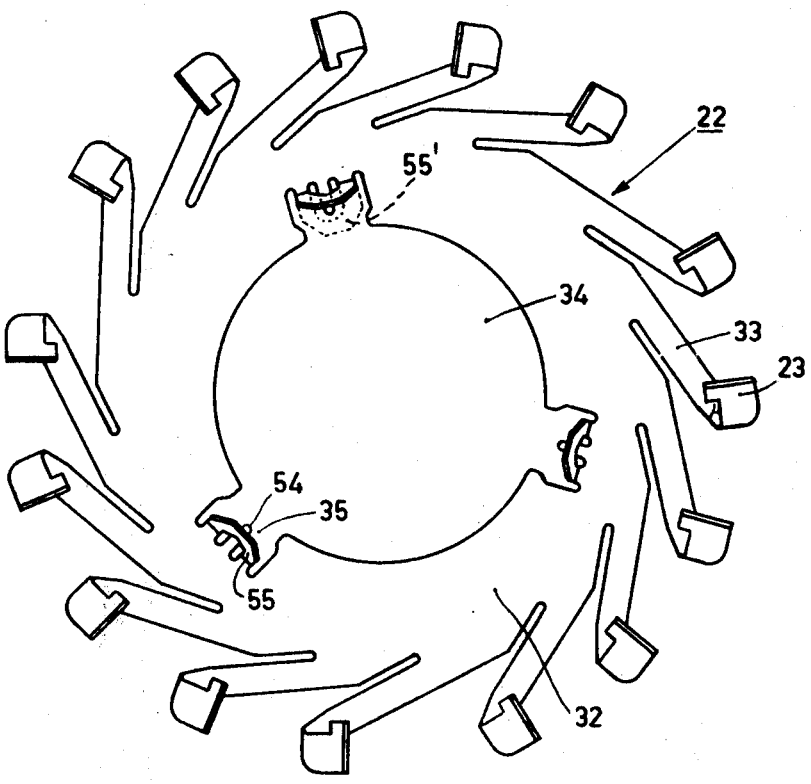
FIG. 9 is a plan view on an enlarged scale of a modification of a hair pulling member consisting of lead cutters, connecting arms and a central plate-shaped portion.

FIG. 9 concerns a hair pulling member 22 which in accordance with the embodiment described above consists of lead cutters 23, connecting arms 33 and a central plate-shaped portion 32 having a central opening 34 and three recesses 35 on its inner periphery. Three radially inwardly directed connection tabs 54 are located in the recesses 35. These connection tabs 54 are so dimensioned that when assembling hair pulling member 22 and coupling piece 24 the connection tabs 54 are slightly bent out of the plane of the central plate-shaped portion 32. The ends of the connection tabs 54 scrape thereby over the ridges 44 (FIG. 3) of the coupling piece 24. In the assembled position the connection tabs 54 rest with a small elastic tension against the ribs 44 so that the hair pulling member 22 and the coupling piece 24 in a simple way are safely secured together.

The central plate-shaped portion 32 is also provided with positioning tabs 55 which are bent out of the plane of the central plate-shaped portion. These positioning tabs 55 bridge the connection tabs 54 and serve to position the hair pulling member 22 in relation to the cutting member 21. In the assembled position of both parts the positioning tabs 55 are located in the cut-outs 31 (FIG. 3) of the cutting member 21 and thus define exactly the position of the hair pulling member 22 in relation to the cutting member 21. For the sake of clarity an unbent positioning tab 55' stretched out in the plane of the central plate-shaped portion 32 is indicated in FIG. 9 by dotted lines.

We claim:

1. A shaving apparatus having a circular shear plate provided with hair-entrance apertures and a cutting unit associated with and rotatable relative to the shear plate; said cutting unit comprising a cutting member having a circular central body, cutters extending from the circumference of said central body toward the shear plate, lead cutters respectively associated with and movable relative to the cutters, each lead cutter, with reference to the direction of rotation of the cutting unit, being positioned in front of its associated cutter, a hair-pulling member having a circular central plate-shaped portion, respective connecting arms securing the lead cutters to the circumference of the central plate-shaped portion, and a coupling piece for securing the cutting member and the hair-pulling member together, said central body and said central plate-shaped portion each having a central opening for reception of the coupling piece, the central plate-shaped portion at the periphery of its central opening being provided with at least one substantially radially inwardly directed connection tab for contact with the coupling piece.

* * * * *